US008526865B2

(12) United States Patent
Nishiwaki

(10) Patent No.: US 8,526,865 B2
(45) Date of Patent: Sep. 3, 2013

(54) DEVELOPER SUPPLY APPARATUS AND IMAGE FORMING APPARATUS

(75) Inventor: Kenjiro Nishiwaki, Aichi (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 312 days.

(21) Appl. No.: 12/884,992

(22) Filed: Sep. 17, 2010

(65) Prior Publication Data

US 2011/0002716 A1 Jan. 6, 2011

Related U.S. Application Data

(63) Continuation-in-part of application No. PCT/JP2009/054280, filed on Mar. 6, 2009.

(30) Foreign Application Priority Data

Mar. 18, 2008 (JP) ..... 2008-068795

(51) Int. Cl.
*G03G 15/01* (2006.01)

(52) U.S. Cl.
USPC ..... 399/291

(58) Field of Classification Search
USPC ..... 399/265, 266, 289–291
See application file for complete search history.

(56) References Cited

U.S. PATENT DOCUMENTS

| | | | | |
|---|---|---|---|---|
| 4,598,991 | A | 7/1986 | Hosoya et al. | |
| 5,416,568 | A | 5/1995 | Yoshiki et al. | |
| 6,965,742 | B2 * | 11/2005 | Miyamoto et al. | 399/50 |
| 7,123,864 | B2 | 10/2006 | Miyaguchi et al. | |
| 8,095,052 | B2 | 1/2012 | Nishiwaki et al. | |
| 2004/0240907 | A1 | 12/2004 | Miyaguchi et al. | |
| 2007/0147904 | A1 | 6/2007 | Maeda | |
| 2010/0028056 | A1 | 2/2010 | Nishiwaki | |
| 2011/0013947 | A1 | 1/2011 | Uno et al. | |

FOREIGN PATENT DOCUMENTS

| | | | |
|---|---|---|---|
| JP | 59-181371 | A | 10/1984 |
| JP | 63-013079 | A | 1/1988 |
| JP | 5-019615 | A | 1/1993 |
| JP | 6-003937 | A | 1/1994 |
| JP | 2002268375 | A | 9/2002 |
| JP | 2003-084569 | A | 3/2003 |
| JP | 2004-287095 | A | 10/2004 |

(Continued)

OTHER PUBLICATIONS

JP Office Action dtd Jun. 29, 2009, JP Appln. 2008-028367.

(Continued)

*Primary Examiner* — David Gray
*Assistant Examiner* — Gregory H Curran
(74) *Attorney, Agent, or Firm* — Banner & Witcoff, Ltd.

(57) ABSTRACT

An image forming device is provided which includes a developer carrying body and a developer supply device to supply a developer to the developer carrying body. The developer supply device includes a plurality of transfer electrodes, and a transfer voltage applying unit to apply traveling-wave shaped transfer voltages to the plurality of transfer electrodes. The developer includes a fine particle charged in a predetermined polarity and a fine particle charged in a polarity opposite to the predetermined polarity. The transfer voltage applying unit is configured to apply the transfer voltages having waveforms, which make a fly height of the fine particle charged in the predetermined polarity higher than a fly height of the fine particle charged in the opposite polarity, to the plurality of transfer electrodes.

5 Claims, 6 Drawing Sheets

(56) References Cited

FOREIGN PATENT DOCUMENTS

| | | | |
|---|---|---|---|
| JP | 2005022253 | A | 1/2005 |
| JP | 2007178924 | A | 7/2007 |
| JP | 2008026759 | A | 2/2008 |

OTHER PUBLICATIONS

JP Office Action dtd Sep. 1, 2009, JP Appln. 2008-028367.
JP Office Action dtd Nov. 11, 2009 JP Appln. 2008-028367.
Written Opinon dtd May 19, 2009, PCT/JP2009/052038.
International Search Report mailed May 19, 2009, PCT/JP2009/052038.
Non-Final Office Action mailed May 14, 2012, U.S. Appl. No.12/851,789.
International Search Report dtd May 28, 2009, PCT/JP2009/054280.
JP Office Action dtd Jun. 9, 2009, JP Appln. 2008-028367, [correct office action date, submitted Aug. 15, 2012].

* cited by examiner

DEVELOPER SUPPLY APPARATUS AND IMAGE FORMING APPARATUS

CROSS REFERENCE TO RELATED APPLICATION

This is a Continuation-in-Part of International Application No. PCT/JP2009/054280 filed Mar. 6, 2009, which claims priority from Japanese Patent Application No. 2008-068795 filed Mar. 18, 2008. The entire disclosure of the prior application is hereby incorporated by reference herein its entirety.

TECHNICAL FIELD

This invention relates to an image forming device and a developer supply device.

BACKGROUND

As a mechanism to be applied to an image forming device based on an electrophotographic method, many mechanisms are known in which a charged developer (toner) is transferred using traveling wave electric fields (for example, Japanese Patent Provisional Publication No. SHO 59-181371). In such a mechanism, a plurality of linear electrodes are arranged in parallel in a transfer direction on an insulating substrate.

In the above configuration, traveling wave electric fields are formed by applying multi-phase alternating current voltages to the plurality of linear electrodes. The charged developer is transferred in a predetermined direction by an effect of the traveling wave electric fields.

SUMMARY

In the mechanism described above, the toners often cohere during transferring, and the cohered toners adhere to the toner transfer mechanism. This results in a poor toner transfer state, and adversely affects image formation. An image forming device and a developer supply device in accordance with embodiments of the present invention explained below can successfully transfer a charged developer with traveling wave electric fields, while forming a fine image.

The image forming device including a developer carrying body and the developer supply apparatus is provided through the embodiment of the present invention. The developer carrying body has a developer carrying surface on which a developer including a plurality of fine particles is carried. In addition, the developer supply device is configured to supply a developer, which includes fine particles charged in a predetermined polarity and fine particles charged in an opposite polarity to the predetermined polarity, to the developer carrying body, while transferring the developer along a developer transfer path. Further, the developer supply device includes a plurality of transfer electrodes arranged along the developer transfer surface facing to the developer transfer path, and a transfer voltage applying unit which is electrically connected to the plurality of transfer electrodes so as to be able to apply transfer voltages shaped in a traveling-wave form to the plurality of transfer electrodes. The transfer voltage applying unit is configured to apply the transfer voltages shaped in a waveform, which makes a flying height of the fine particle charged in the predetermined polarity higher than that of the fine particle charged in the polarity which is opposite to the predetermined polarity, to the transfer electrodes.

DETAILED DESCRIPTION OF EMBODIMENTS

Hereinafter, an exemplary embodiment of the present invention is explained with reference to figures.

Further, the following description about the embodiment of the present invention is merely an explanation about one embodiment among various embodiments for implementing the present invention. Naturally, a scope of the present invention is not limited, in any way, to a concrete configuration of the embodiment explained below.

1. Configuration of Laser Printer

Figure 1:
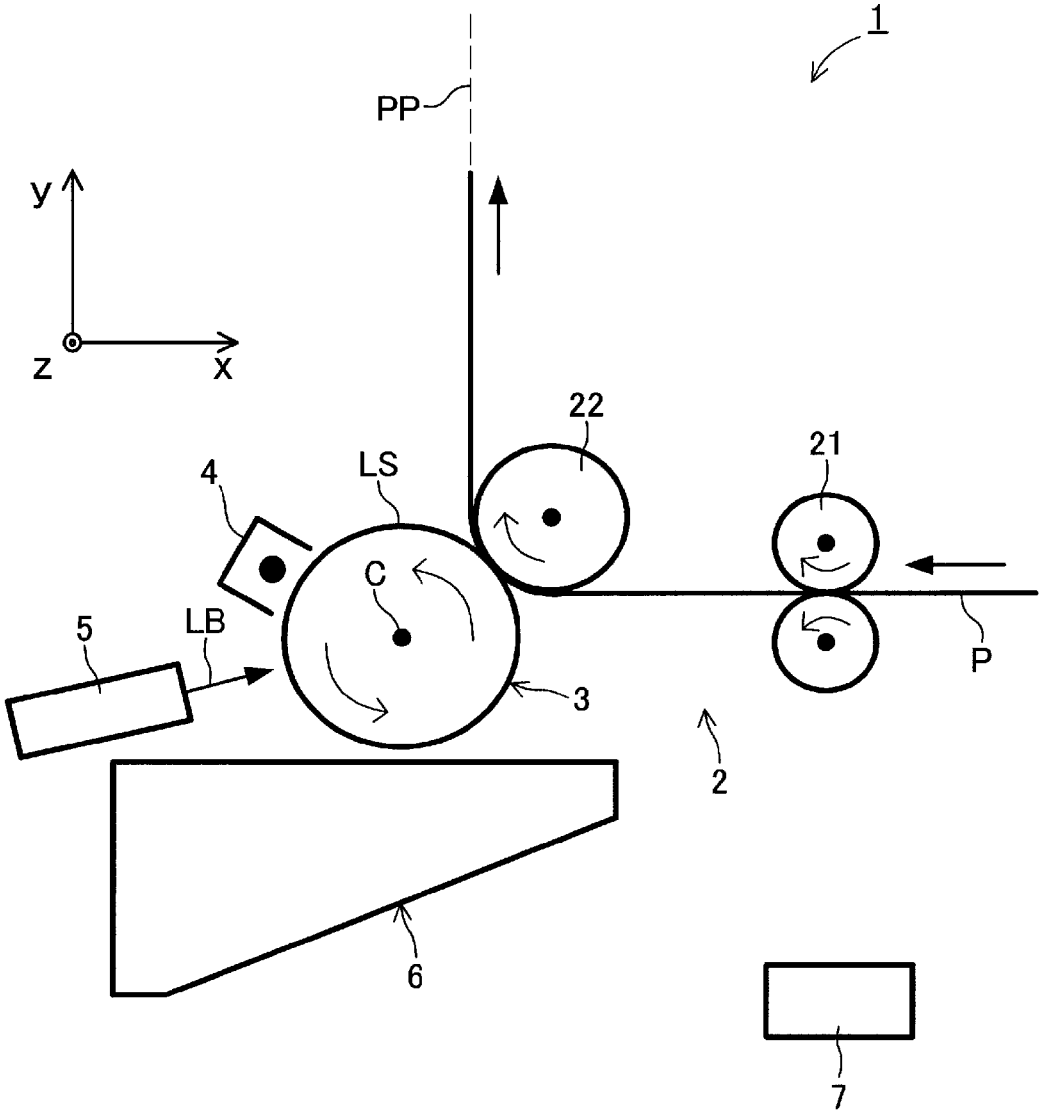
FIG. 1 is a diagram illustrating a schematic configuration of a laser printer in accordance with one embodiment of the present invention.

FIG. 1 is a diagram illustrating a schematic configuration of a laser printer 1 (image forming device) according to an embodiment of the present invention.

Referring to FIG. 1, the laser printer 1 includes a document transfer mechanism 2, a photosensitive drum 3, a charger 4, a scanner unit 5, a toner supply device 6, and controller 7.

Sheets of paper P are stored in a stacked state in a document feeding tray, not shown in the figure, included in the laser printer 1. The document transfer mechanism 2 is configured to be able to pick up sheets of paper P stored in the document feeding tray one by one, and transfer the sheet of paper along a predetermined document transfer path PP.

The photosensitive drum 3 (developer carrying body) is a cylindrically-shaped assembly, and a latent image forming surface LS (developer carrying surface) is formed on its cylindrical surface. The latent image forming surface LS is configured such that an electrostatic latent image, which is an electric potential distribution, can be formed on it.

In addition, the photosensitive drum 3 is arranged such that its central axis C extends in a main scanning direction (the z-axis direction in the figure), and it is configured to be able to be rotationally driven around the central axis C, which is the center of the rotation, in the direction indicated by an arrow in the figure. Therefore, the latent image forming surface LS can be moved along a sub-scanning direction which is perpendicular to the main scanning direction at a position where a laser beam LS, which is described later, forms an image.

The charger 4 is placed to face with the latent image forming surface LS. The charger 4 is a scorotron type charger configured to be able to charge the latent image forming surface LS positively and uniformly. The type of the charger is not limited to the scorotron type, and a charger with another configuration, such as a scorotron type charger or a charger of a type where a sawtooth electrode is utilized, can be used.

The scanner unit 5 is configured to generate a laser beam LB which is modulated based on image data. In addition, the scanner unit 5 is configured to make the laser beam LB form an image on the latent image forming surface LS, and to expose the photosensitive drum. The laser beam LB forms an image at a position downstream of the charger 4 in the direction of the rotation of the photosensitive drum 3 (counter-clockwise direction in FIG. 1). In addition, the scanner unit 5 is configured to make the position, at which the laser beam LB forms an image, move (scan) in the main scanning direction along the latent image forming surface LS at a constant velocity.

The toner supply device 6 (developer supply device) is placed to face with the latent image forming surface LS of the photosensitive drum 3. A detailed configuration of the toner supply device 6 is described later.

The controller 7 includes a control circuit for controlling each component included in the laser printer 1, and a power supply circuit to supply predetermined voltages to the respective components.

Next, more detailed configurations of the respective components of the laser printer 1 are explained.

1-1 Document Transfer Mechanism

The document transfer mechanism 2 includes a pair of registration rollers 21 and a transfer roller 22. The registration rollers 21 are configured to send out a sheet of paper P to a gap between the photosensitive drum 3 and the transfer roller 22 at a predetermined timing.

The transfer roller 22 is placed to face with the latent image forming surface LS, which is the cylindrical surface of the photosensitive drum 3, with the sheet of paper P pinched therebetween. The transfer roller 22 is configured to be able to rotationally driven in the direction indicated by the arrow (clockwise) in FIG. 1. The transfer roller 22 is connected to a bias power supply circuit included in the controller 7 so that a predetermined transfer bias voltage for transferring a toner (developer) adhering on the latent image forming surface LS to the sheet of paper P is applied to between the transfer roller 22 and the photosensitive drum 3.

1-2. Photosensitive Drum

Figure 2:
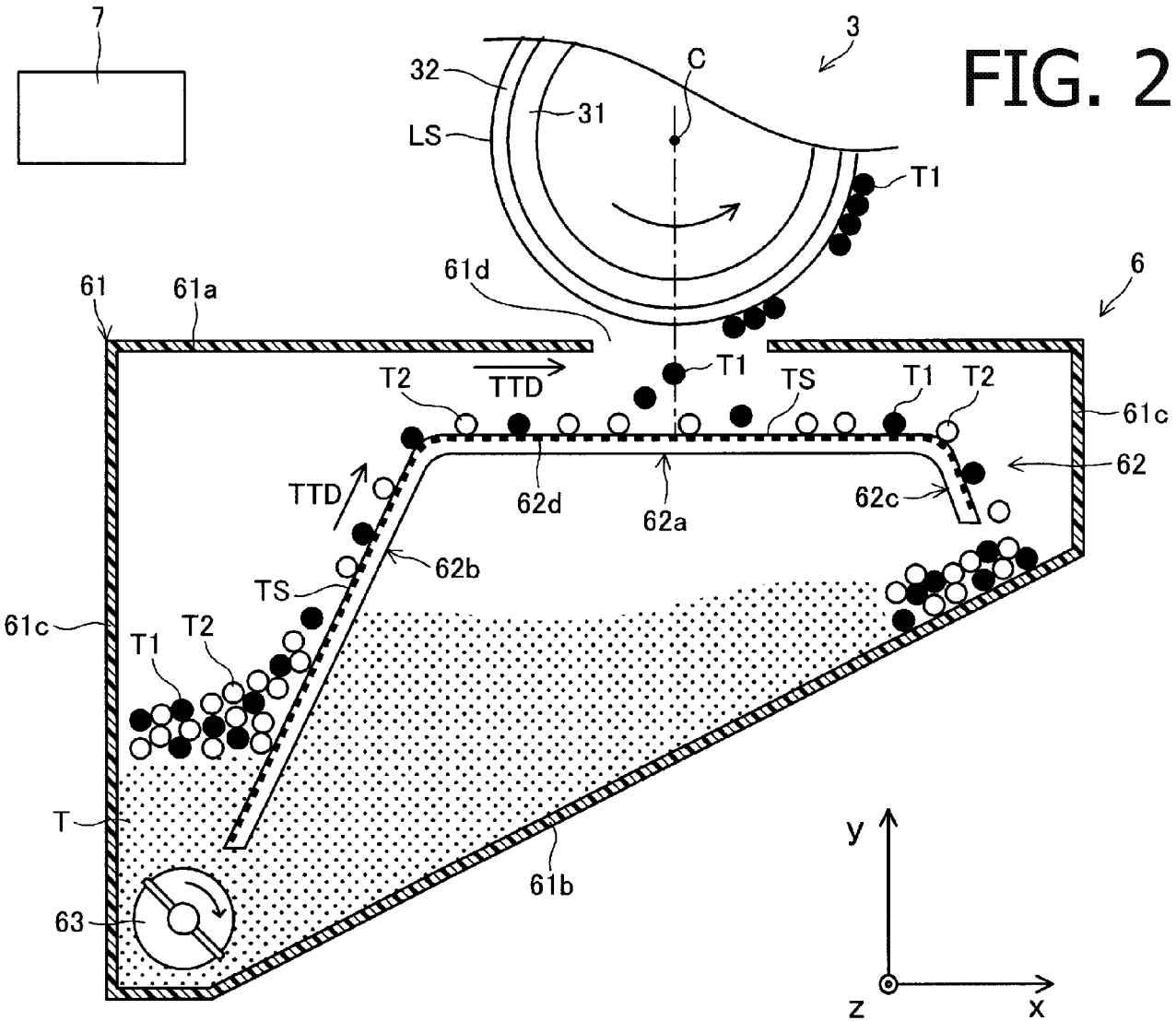
FIG. 2 is a schematic sectional side view magnifying a portion where a photosensitive drum and a toner supply device shown in FIG. 1 are facing each other.

FIG. 2 is a schematic cross sectional view magnifying the portion where the photosensitive drum 3 and the toner supply device 6, shown in FIG. 1, face each other. Referring to FIG. 2, the photosensitive drum 3 includes a drum main body 31 and a photosensitive layer 32.

The drum main body 31 is a cylindrical assembly having the central axis C, the central axis C being parallel to the main scanning direction. The drum main body 31 is formed with a metal, such as aluminum. The drum main body 31 is grounded.

The photosensitive layer 32 is provided to cover the cylindrical surface of the drum main body 31. The photosensitive layer 32 includes a photoconductive layer with a positive charging characteristic, which shows an electric conductivity during exposure of laser light with a predetermined wavelength. The latent image forming surface LS is composed of an outer circumferential surface of the photosensitive layer 32.

1-3. Toner Supply Device

Referring to FIG. 2, the toner supply device 6 is configured to be able to supply a toner T, which is a fine-grain dry developer (powdery developer), in a charged state to the latent image forming surface LS, while transferring the toner T in a toner transfer direction TTD.

A toner box 61 which forms a casing of the toner supply device 6 includes a top plate 61*a*, a bottom plate 61*b*, and four pieces of side plates 61*c*. Almost the same amounts of a toner T1 having a positive charging characteristic and a toner T2 having a negative charging characteristic are stored inside of the toner box 61 in a state where they are mixed with each other. Here, the toner T1 having the positive charging characteristic is a toner which tends to be charged in a positive polarity through friction with the toner T2 having the negative charging characteristic. In addition, the toner T2 having the negative charging characteristic is a toner which tends to be charged in a negative polarity through friction with the toner T1 having the positive charging characteristic. Further, in this embodiment, a development is performed mainly through adhesion of the toner T1 having the positive charging characteristic on the electrostatic latent image, as described later. In such a case, it is preferable that the toner T1 having the positive charging characteristic also has a tendency to be charged in the positive polarity through friction with an agitator 63 or with the toner box 61. Conversely, in another embodiment where the development is performed mainly through adhesion of the toner T2 having the negative charging characteristic on the electrostatic latent image, it is preferable that the toner T2 having the negative charging characteristic also has a tendency to be charged in the negative polarity through friction with the agitator 63 or with the toner box 61.

The top plate 61*a* is a rectangular plate-like member, and positioned in parallel with the horizontal surface. The bottom plate 61*b* is a rectangular plate-like member, and positioned below the top plate 61*a*. The bottom plate 61*b* is arranged at a slant such that a point on the bottom plate 61*b* rises in the positive direction in the y-axis, as the point moves in the positive direction in the x-axis in the figure. The toner box 61 is configured to be able to store the toner T, without leaking it to the outside, through connecting four sides of the top plate 61*a* and the four sides of the bottom plate 61*b* with the four pieces of side plates 61*c* (only two pieces of side plates 61*c* are shown in FIG. 2).

A toner passage aperture 61*d* is formed on the top plate 61*a*. The toner passage aperture 61*d* is formed at an adjacent position between the top plate 61*a* and the photosensitive layer 32. The toner passage aperture 61*d* is formed in a rectangular shape having long edges in parallel with the main scanning direction (z-axis direction in the figure) and short edges in parallel with the sub-scanning direction (x-axis direction in the figure). The long edges have the length substantially the same as a width of the photosensitive layer 32. The toner passage aperture 61*d* is formed as a through-hole such that the toner T can pass through it when the toner T moves from inside of the toner box 61 to the photosensitive layer 32 along the y-axis direction in the figure.

A toner transfer body 62 is stored inside of the toner box 61. The toner transfer body 62 is a plate-like member having a predetermined thickness. The toner transfer body 62 includes a central portion 62*a*, an upstream portion 62*b*, and a downstream portion 62*c*.

The central portion 62*a* is formed in a substantially rectangular shape in plane view. A length of a long edge of the central portion 62*a* is substantially the same as the width in the main scanning direction of the photosensitive drum 3, and a length of a short edge of the central portion 62*a* is longer than a diameter of the photosensitive drum 3. The central portion 62*a* is provided at a position such that its center in the sub-scanning direction coincides with a center of the toner passage aperture 61*d* in the sub-scanning direction when viewed along the y-axis, and it also coincides with the central axis C of the drum main body 31. Namely, the central portion 62*a* is arranged substantially parallel with the top plate 61*a* so as to face with the latent image forming surface LS through the toner passage aperture 61*d*.

The upstream portion 62 *b* is a plate-like member which extends obliquely from an end portion of the central portion

62*a* at an upstream side in the toner transfer direction TTD toward further to the upstream side (obliquely downwardly). Namely, the upstream portion 62*b* is obliquely positioned with respect to the horizontal surface such that it rises as it become closer to the central portion 62*a*. In addition, an end portion of the upstream portion 62*b* at the upstream-most side in the toner transfer direction TTD reaches to a neighborhood of the deepest portion of the toner box 61. Therefore, even if the amount of the toner T is a few, a part (bottom part) of the upstream component 62*b* can be buried in the toner T.

The downstream portion 62*c* is a plate-like member which extends from an end portion of the central portion 62*a* at a downstream side in the toner transfer direction TTD toward further to the downstream side (obliquely downwardly). Namely, the downstream portion 62*b* is obliquely positioned with respect to the horizontal surface such that it lowers as it becomes farther from the central portion 62*a*. In addition, an end portion of the downstream portion 62*c* at the downstream-most side in the toner transfer direction TTD reaches to a neighborhood of the side plate 61*c* at the downstream-most side in the toner transfer direction TTD, which is a neighborhood of the bottom plate 61*b* of the toner box 61 (namely, a neighborhood of the shallowest part of the toner box 61). Therefore, the toner T can flow back to the bottom plate 61*b* smoothly.

The toner transfer body 62 has a toner transfer surface TS which is in parallel with the main scanning direction. The toner transfer body 62 is positioned such that the toner transfer surface TS faces with the latent image forming surface LS at substantially center of the central portion 62*a* in the toner transfer direction TTD. The toner transfer body 62 includes transfer electrodes 62*d*, a supporting plate 62*e*, and a coating membrane 62*f*.

Figure 3:
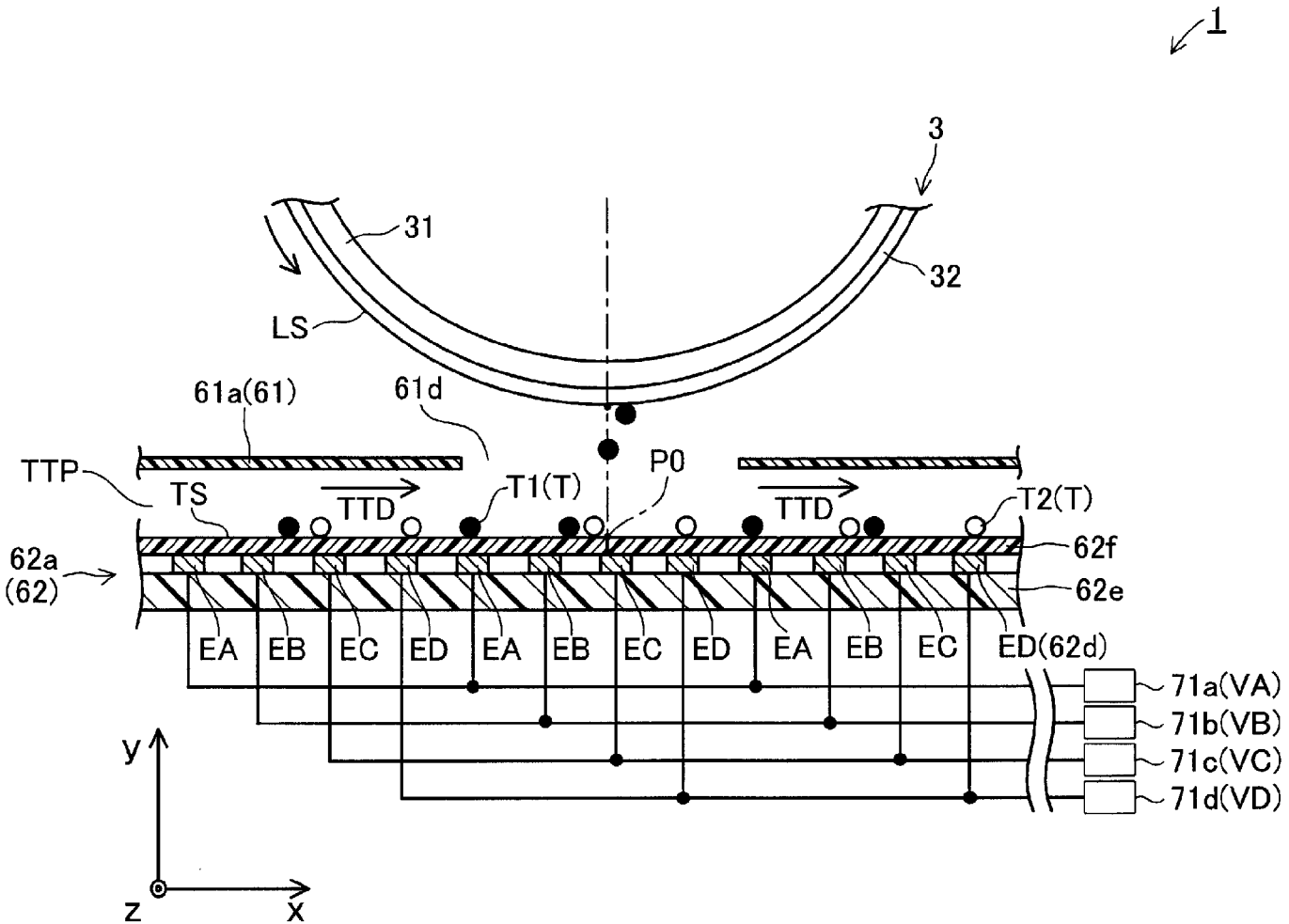
FIG. 3 is a schematic sectional side view magnifying a portion where a toner transfer body and the photosensitive drum are facing to each other.
Figure 4A:
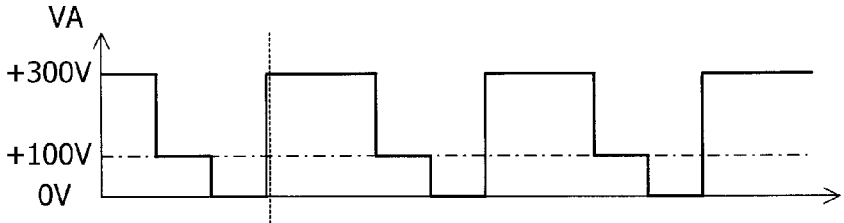
FIG. 4A-FIG. 4D are graphs illustrating waveforms of transfer voltages supplied by a transfer voltage applying unit shown in FIG. 3.
Figure 4B:
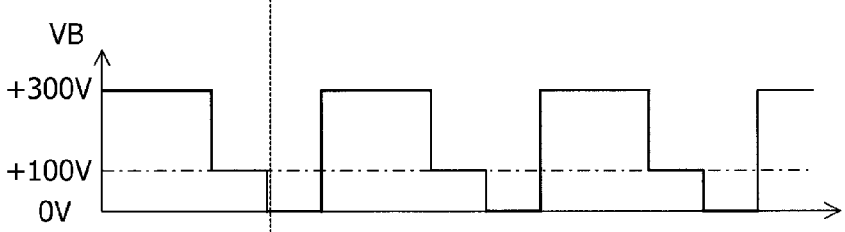
Figure 4C:
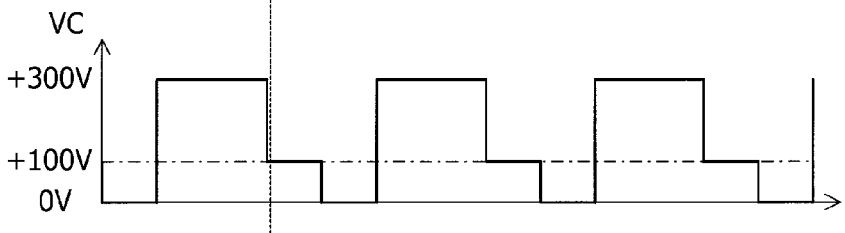
Figure 4D:
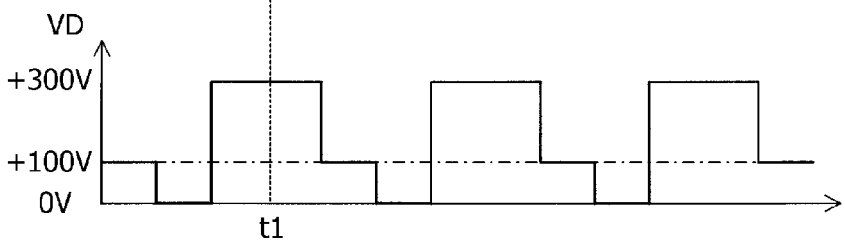

FIG. 3 is a schematic sectional side view magnifying the portion shown in FIG. 2, the portion where the toner transfer body 62 and the photosensitive drum 3 are facing to each other. Hereinafter, an internal configuration of the toner transfer body 62 is explained with reference to FIG. 2 and FIG. 3.

The plurality of transfer electrodes 62*d* (EA-ED) are arranged in a neighborhood of the toner transfer surface TS along a toner transfer path TTP (a path along which the toner T is transferred by traveling wave electric fields). Each of the transfer electrodes 62*d* is a wiring pattern made of a metallic thin film and shaped in a thin line (about 0.1 mm in thickness). The plurality of transfer electrodes 62*d* are evenly spaced apart along the sub-scanning direction (about 0.2 mm pitch), while its longitudinal direction is directed to the main scanning direction (in FIG. 2 and FIG. 3, sizes and positional relationships of the transfer electrodes 62*d* and other parts shown are exaggerated than the actual sizes and positional relationships, for clarity of the illustration).

The transfer electrodes 62 are formed on the supporting plate 62*e*. The supporting plate 62*e* shows an excellent insulation property, and it is a plate-like member made of a synthetic resin. The surface of the supporting plate 62*e*, on which the transfer electrodes 62*d* are formed, is covered with the coating membrane 62*f* made of nylon which is a synthetic resin. The toner transfer surface TS is composed of a surface of the coating membrane 62*f* made of the synthetic resin.

An agitator 63, which is a churner, is provided at the deepest portion of the toner box 61, namely, below the bottom end of the upstream portion 62*b* in the toner transfer body 62. The agitator 63 is configured to be able to rotate in the direction indicated by the arrow in the figure (clockwise). Therefore, the agitator 63 agitates the toner T at the deepest portion of the toner box 61 and makes the toner T flow. The agitator 63 can make the toner T be charged, through creating friction between the toner T and the toner transfer surface TS, or friction among the toners T themselves (especially, friction between the toner T1 having the positive charging characteristic and the toner T2 having the negative charging characteristic).

The controller 7 includes transfer voltage applying units 71*a*, 71*b*, 71*c*, and 71*d*. Among the plurality of transfer electrodes 62*d* arranged along the sub-scanning direction (the x-axis direction in the figure), a group of the electrodes spaced evenly apart by three electrodes (indicated by a symbol EA in the figure) are connected to the same transfer voltage applying unit 71*a*. Similarly, a group of the electrodes 62*d* indicated by a symbol EB in the figure are connected to the same transfer voltage applying unit 71*b*, a group of the electrodes 62*d* indicated by a symbol EC in the figure are connected to the same transfer voltage applying unit 71*c*, and a group of the electrodes 62*d* indicated by a symbol ED in the figure are connected to the same transfer voltage applying unit 71*d*.

Namely, the transfer electrode EA connected to the transfer voltage applying unit 71*a*, the transfer electrode EB connected to the transfer voltage applying unit 71*b*, the transfer electrode EC connected to the transfer voltage applying unit 71*c*, the transfer electrode ED connected to the transfer voltage applying unit 71*d*, the transfer electrode EA connected to the transfer voltage applying unit 71*a*, the transfer electrode EB connected to the transfer voltage applying unit 71*b*, . . . , are arranged along the sub-scanning direction in this order.

The transfer voltage applying units 71*a*, 71*b*, 71*c*, and 71*d* are power supply circuits which can supply alternating current voltages, and configured to generate alternating current voltages having substantially the same waveform and having phases evenly shifted by ¼ cycle.

FIG. 4A-FIG. 4D are graphs illustrating waveforms of the transfer voltages supplied by the transfer voltage applying units 71*a*-71*d*, shown in FIG. 3. The transfer voltage applying unit 71*a* is configured to supply a rectangular wave-shaped transfer voltage VA such that, after descending from a first high voltage (+100V) to a reference voltage (0V) in a stepwise fashion (this difference in voltages is referred to as "first voltage difference"), the voltage rises steeply from the reference voltage (0V) to a second high voltage (+300V) in a stepwise fashion, then, the voltage descends from the second high voltage (+300V) to the first high voltage (+100V) in a stepwise fashion (this difference in voltages is referred to as "second voltage difference"), as shown in FIG. 4A-FIG. 4D.

The transfer voltage applying unit 71*b* is configured to supply a transfer voltage VB having substantially the same waveform as that of the transfer voltage VA and having a phase that is advanced by ¼ cycle compared with the phase of the transfer voltage VA. Namely, the transfer voltage applying unit 71*b* is configured so that the transfer voltage VB descends from the first high voltage (+100V) to the reference voltage (0V) when the transfer voltage VA steeply rises from the reference voltage (0V) to the second high voltage (+300V), the transfer voltage VB rises from the reference voltage (0V) to the second high voltage (+300V) while the transfer voltage VA is at the second high voltage (+300V), the transfer voltage VB is retained at the second high voltage (+300V) when the transfer voltage VA descends from the second high voltage (+300V) to the first high voltage (+100V), and the transfer voltage VB descends from the second high voltage (+300V) to the first high voltage (+100V) when the transfer voltage VA descends from the first high voltage (+199V) to the reference voltage (0V).

Similarly, the transfer voltage applying unit 71*c* is configured to supply a transfer voltage VC having substantially the same waveform as that of the transfer voltage VA and having a phase that is advanced by ¼ cycle compared with the phase of the transfer voltage VB. In addition, the transfer voltage applying unit 71*d* is configured to supply a transfer voltage VD having substantially the same waveform as that of the transfer voltage VA and having a phase that is advanced by ¼ cycle compared with the phase of the transfer voltage VC.

In this manner, the respective transfer electrodes 62*d* are configured and arranged to form traveling-wave shaped electric fields, which can transfer the toner T on the toner transfer surface TS in the toner transfer direction TTD, by applying traveling-wave shaped voltages from the transfer voltage applying units 71*a*-71*d*.

2. Operations of Laser Printer

Next, operations of the laser printer 1 configured as described above are explained, while referring to the figures appropriately.

2-1. Document Feeding Operations

First, a tip of the sheet of paper P stacked in the document feeding tray, not shown in figures, is sent to the registration rollers 21 (FIG. 1). A skew of the sheet of paper P is corrected and a timing of transferring the sheet of paper P to a transfer position is adjusted by the registration rollers 21. After that, the sheet of paper P is fed to the transfer position where the photosensitive drum 3 and the transfer roller 22 are facing to each other.

2-2. Toner Image Supported on Latent Image Forming Surface

An image is formed with the toner T, as below, and supported on the latent image forming surface LS which is an outer circumferential surface of the photosensitive drum 3, while the sheet of paper P is transferred to the transfer position as described above.

2-2-1. Formation of Electrostatic Latent Image

First, the latent image forming surface LS of the photosensitive drum 3 is uniformly charged in the positive polarity with the charger 4.

The latent image forming surface LS charged with the charger 4 is moved to a scan position, which is a position facing to the scanner unit 5, by rotation of the photosensitive drum 3 in the direction indicated by the arrow in the figure (counterclockwise). At the scan position, the laser beam LB modulated based on the image information is irradiated on the latent image forming surface LS, while it is scanned along the main scanning direction. At the portion irradiated by the laser beam LB, photoconductivity is induced on the photosensitive layer, and positive charges supported on the latent image forming surface LS move to the drum main body 31 and disappear. Namely, depending on a state of the modulation of the laser beam LB, a portion arises where the positive charges on the latent image forming surface LS disappear. With this, an electrostatic latent image formed by an image-like distribution of the positive charges is formed on the latent image forming surface LS.

The electrostatic latent image formed on the latent image forming surface LS moves toward the position facing to the toner supply device 6 by the rotation of the photosensitive drum 3 in the direction indicated by the arrow in the figure (counterclockwise).

2-2-2. Transfer, Supply of Charged Toner

Referring to FIG. 2, the agitator 63 rotates in the direction indicated by the arrow in the figure (clockwise). With this, friction between the toner T and the toner transfer surface TS in the upstream portion 62*b* (the surface of the coating membrane 62*f* of the synthetic resin in FIG. 3) and friction among the toners T themselves are created. With these frictions (especially, friction between the toner T1 having the positive charging characteristic and the toner T2 having the negative charging characteristic), the toner T1 having positive charging characteristic is charged in the positive polarity and the toner T2 having the negative charging characteristic is charged in the negative polarity, respectively.

The transfer voltages VA-VD shown in FIG. 4A-FIG. 4D are applied to the plurality of transfer electrode 62*d* of the toner transfer body 62. With this, a predetermined traveling wave shaped electric fields are formed on the toner transfer surface TS. With the electric fields, the toner T moves upwardly along the slanted toner transfer surface TS in the upstream portion 62*b*, and reaches to the central portion 62*a*. Then, the toner T is transferred to a position, which is the closest position to the toner transfer body 62 (the most proximity position P0), along the toner transfer path TTP.

In a neighborhood of the most proximity position P0, the toner T1 having the positive charging characteristic adheres to the portion where the positive charges of the electrostatic latent image formed on the latent image forming surface LS have disappeared. Namely, the electrostatic latent image formed on the latent image forming surface LS is developed with the toner T1 having the positive charging characteristic. With this, the image developed by the toner T (hereinafter, referred to as "toner image") is supported on the latent image forming surface LS. The toner T which passes the most proximity position P0 without supported on the latent image forming surface LS is returned to the bottom part of the toner box 61 through the downstream portion 62*c*.

2-2-3. Development of Electrostatic Latent Image

Figure 5A:
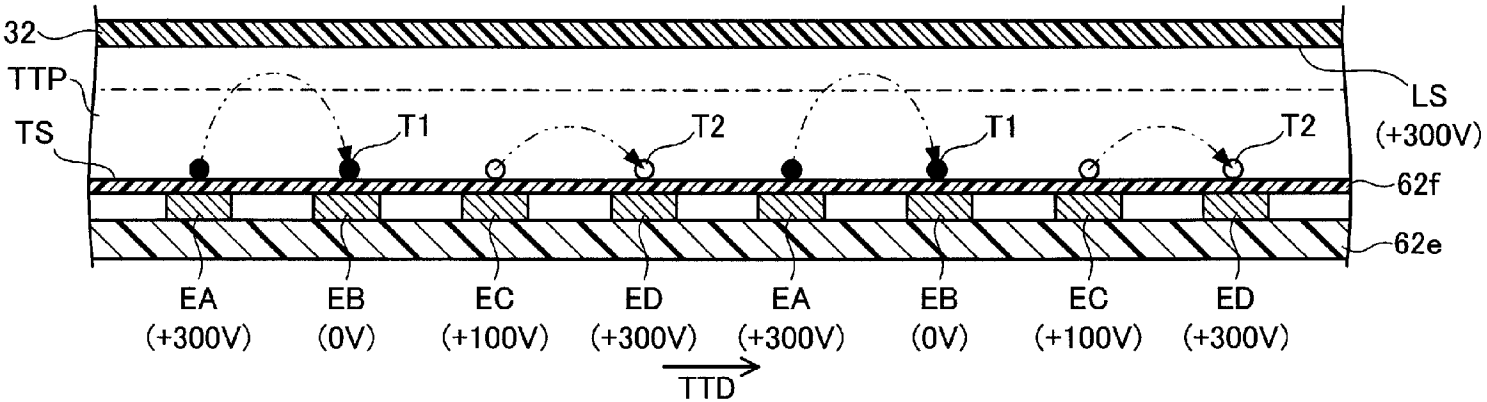
FIG. 5A and FIG. 5B are schematic sectional side views magnifying and illustrating a neighboring area of the most proximity position P0 where a photosensitive layer and the toner transfer body shown in FIG. 3 become closest to each other.
Figure 5B:
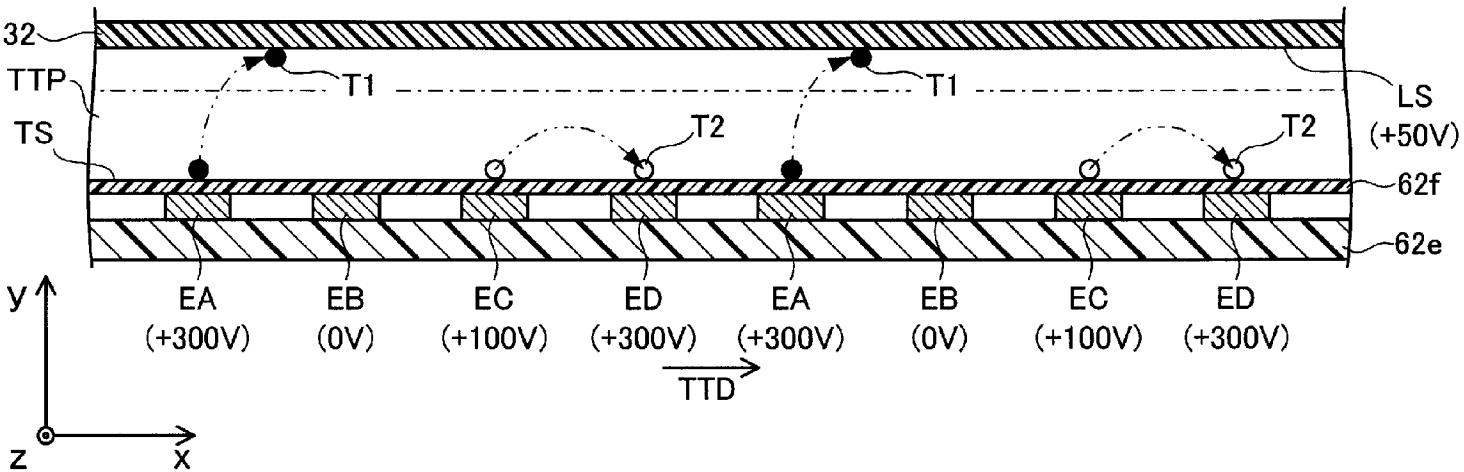
Figure 6A:
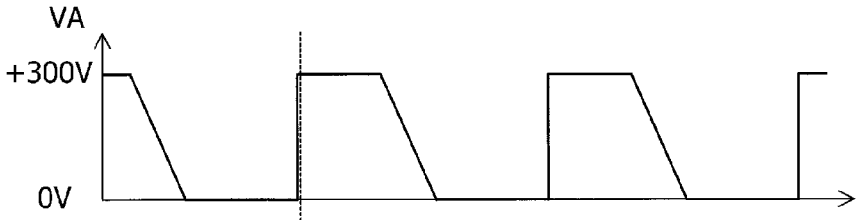
FIG. 6A-FIG. 6D are graphs illustrating a modified example of the waveforms of the transfer voltages shown in FIG. 4A-4D.
Figure 6B:
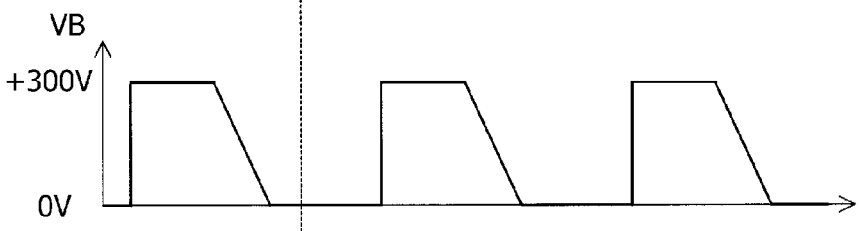
Figure 6C:
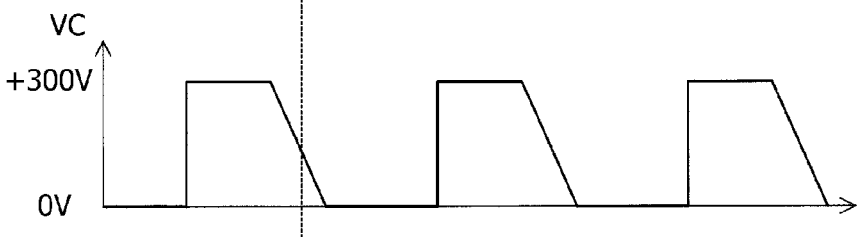
Figure 6D:
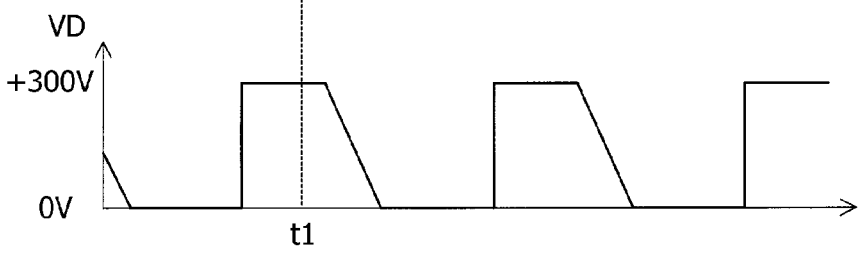

FIG. 5A and FIG. 5B are schematic sectional side views magnifying a neighboring area of the most proximity position P0 where the photosensitive layer 32 and the toner transfer body 62 shown in FIG. 3 become closest to each other. Hereinafter, a manner of developing the electrostatic latent image is explained with reference to FIG. 4A-FIG. 4D, FIG. 5A and FIG. 5B.

With the application of the above described transfer voltages VA-VD, the toner T1 having the positive charging characteristic and the toner T2 having the negative charging characteristic move in the toner transfer direction TTD, while hopping in the y-axis direction in FIG. 5A and FIG. 5B (cf., the arrows of two-point dashed lines in the figure).

Here, at a time t1 in FIG. 4A-4D, after the voltage of the transfer electrode EA rises greatly from the reference voltage (0V) to the second high voltage (+300V), the voltage of the transfer electrode EB becomes the reference voltage (0V). At the moment, the voltage of the transfer electrode ED, which is neighboring to the transfer electrode EA, is the second high voltage (+300V), the same voltage as that of the transfer electrode EA. In addition, the voltage of the transfer electrode EC, which is placed in between the transfer electrode EB having the reference voltage (0V) and the transfer electrode ED having the second high voltage (+300V), is the second high voltage (+100V).

Then, as shown in FIGS. 5A and 5B, a voltage between the transfer electrode EA and the neighboring electrode EB (hereinafter, referred to as "voltage AB," similarly for the others) become the maximum. With this, the toner T1 having the positive charging property hops high enough to reach a range (cf., a single-point dashed line in the figure) where a developing electric field (for the toner T1 having the positive charging characteristic to be flown to the latent image forming surface LS, namely, the electric field for developing the electrostatic latent image) acts. On the other hand, a voltage BC (the first voltage difference), a voltage CD (the second voltage difference), and a voltage DA is smaller than the voltage AB (corresponding to the sum of the first voltage difference and the second voltage difference, described above). Therefore, the toner T2 having the negative charging characteristic hops lower than the toner T1 having the positive charging characteristic.

As shown in FIG. 5A, a surface voltage (voltage of the latent image forming surface) of a portion of the photosensitive layer 32 corresponding to a non-image part (a part where no dot with the toner T is formed) is V0=+300V. In this case, since an effect of a repulsive force generated by the electrostatic latent image overcomes an effect of the developing electric field, the toner T1 having the positive charging property which hops high does not reach to the latent image forming surface LS, and lands on the toner transfer surface TS. On the other hand, the toner T2 having the negative charging property does not hop so high to reach to the range where the toner T2 receives an attraction force generated by the electrostatic latent image. Thus it lands to the toner transfer surface TS. Therefore, at a non-image part, neither the toner T1 having the positive charging characteristic nor the toner T2 having the negative charging characteristic can adhere on the latent image forming surface LS.

As shown in FIG. 5B, a surface voltage (voltage of the latent image forming surface LS) of the photosensitive layer 32 corresponding to an image part (a part where dots with the toner T are formed) is VL=+50V. In this case, since the effect of the developing electric field overcomes the effect of repulsive force generated by the electrostatic latent image, the toner T1 having the positive charging characteristic, which hops high, reaches to the latent image forming surface LS and adheres on the latent image forming surface LS. On the other hand, since the toner T2 having the negative charging characteristic hops relatively low as described above, it cannot receive the strong attractive force generated by the electrostatic latent image. Therefore, the toner T2 having the negative charging characteristic lands on the toner transfer surface TS, without adhering on the latent image forming surface LS.

2-3. Transfer of Toner Image from Latent Image Forming Surface to Sheet of Paper Referring to FIG. 1, the toner image supported on the latent image forming surface LS of the photosensitive drum 3 is transferred to the transfer position, as the latent image forming surface LS rotates in the direction indicated by the arrow in the figure (counterclockwise). Then, at the transfer position, the toner image is transferred from the latent image forming surface LS onto the sheet of paper P.

3. Function and Effect of Configuration of the Embodiment

In this embodiment, the toner T, in which the toner T1 having the positive charging characteristic and the toner T2 having the negative charging characteristic are mixed, is used. With this, an occurrence of a failure of transferring of the toner T, which arises as a result of an excessive charging of the toner T or the toner transfer body 62, is effectively prevented. Namely, according to this embodiment, the toner T is successfully transferred with the traveling wave electric fields.

Here, in this embodiment, when an electric potential distribution is formed over the electrodes 62*d* arranged toward the downstream side in the toner transfer direction TTD, the distinctive transfer voltages VA-VD, having a waveform, respectively, such that a rising edge is steeper than a falling edge, are applied. And, through application of such distinctive transfer voltages VA-VD, a large voltage is rapidly formed between the neighboring transfer electrodes 62*d* when the toner T1 having the positive charging characteristic moves. On the other hand, a comparatively small voltage is mildly formed between the neighboring transfer electrodes 62*d* when the toner T2 having the negative charging characteristic moves.

Thus, a flying height of the toner T1 having the positive charging characteristic is higher than that of the toner T2 having the negative charging characteristic. Therefore, according to this embodiment, a selective development with the toner T1 having the positive charging characteristic and a suppression of "covering on a white background," which is caused by an adhesion of the toner T2 having the negative charging characteristic to a non-image part, can be successfully executed. Here, "covering on a white background" is said to be a phenomenon in which an unintended toner adheres to a portion where a toner should not adhere (a portion which is positively charged, in the above described embodiment), when forming the toner image on the latent image forming surface LS.

4. Listing of Illustrations of Modified Examples

Further, as described above, the above described embodiment is merely an example of representative embodiments of the present invention. Namely, the present invention is not limited to the above described embodiment. Naturally, various modifications may be made to the above described embodiment within the scope in which essential parts of the present invention are not modified.

Hereinafter, some representative modified examples are illustrated. In the explanation of the modified examples below, in principle, the same symbols as used in the above described embodiment are used for assemblies having the same configurations and functions explained in the above described embodiment. And, for explanations of such assemblies, the explanations in the above described embodiment are quoted within the scope in which they do not technically contradict.

Obviously, the scope of the present invention is not limited by the modified examples listed below. In addition, a plurality of modified examples can be compositely applied, appropriately, within the scope in which they do not technically contradict.

(1) A subject to which the present invention is applied is not limited to a single color laser printer. For example, the present invention can be preferably applied to an image forming device of so-called an electrophotographic type, such as a color laser printer, or a monochrome copier and a color copier. In this case, it is not required that a photosensitive body is shaped like a drum, as in the above described embodiment. For example, the photosensitive body can be shaped like a plate or an endless belt.

(2) In the above described embodiment, the photosensitive drum 3 is cited as an example of the developer carrying body and explained. However, the developer carrying body is not limited to this.

For example, a developing roller or a developing sleeve, which has a cylindrical-surface shaped toner carrying surface with which the toner T is carried in a thin-film like shape, and which is provided to face to the photosensitive drum 3, can be regarded as the developer carrying body.

Alternatively, the present invention can be preferably applied to an image forming device of a type other than the above described electrophotographic type (for example, a toner-jet type without using a photosensitive body, an ion-flow type, or a multi-stylus electrode type). In this case, the sheet of paper P or an intermediary transfer body shaped like a drum or a belt can be regarded as the developer carrying body.

(3) The waveforms of the transfer voltages are not limited to a stepwise shape. For example, the shapes of the transfer voltages VA-VD can be a waveform such that the voltage falls in a slow descending line or curve and the voltage rises steeply (horizontally), as shown in FIG. 6A-FIG. 6D.

(4) The transfer voltage is not limited to a four-phase voltage as in the above described embodiment. For example, the transfer voltage can be a three-phase voltage. In this case, among the plurality of transfer electrodes 62*d*, the transfer electrodes evenly spaced apart by two of them are connected to the same transfer voltage applying unit.

(5) In the above described embodiment, the developer, in which the toner T1 having the positive charging characteristic and the toner T2 having the negative charging characteristic are added, is used. However, the present invention can be effectively applied to a developer supply device or an image forming device which uses a developer which includes only the toner T1 having the positive charging characteristic (or the toner T2 having the negative charging characteristic) as a colored element. A part of the toners T1 having the positive charging characteristic are incidentally charged in the negative polarity, for example, through friction among the toners T1 having the positive charging characteristic themselves. The negatively charged toner T1' having the positive charging characteristic behaves like the toner T2 having the negative charging characteristic during the process of the development. Namely, since the negatively charged toner T1' having the positive charging characteristic hops lower than the positively charged toner T1 having the positive charging characteristic in the neighborhood of the most proximity position P0, it cannot reach to the range where it can receive the attraction force generated by the electrostatic latent image, and it lands on the toner transfer surface TS. Therefore, the negatively charged toner T1' having the positive charging characteristic cannot adhere to a positively charged area on the latent image forming surface LS (area on which no toner should be adhered). Namely, by applying the present invention to a developer supply device which uses the developer which only includes the toner T1 having the positive charging characteristic, an occurrence of "covering on a white background" caused by the negatively charged toner T1' having the positive charging characteristic can be suppressed. Similarly, an effect of preventing the occurrence of "covering on a white background" can be obtained when the present invention is applied to a developer supply device which uses the developer which only includes the toner T2 having the negative charging characteristic.

(6) The above described embodiment is configured such that an image is formed only with the toner T1 having the positive charging characteristic in the toner T. However, the present invention is not limited to such a configuration. For example, the present invention can be preferably applied to a configuration in which an image is formed only with the toner T2 having the negative charging characteristic in the toner T. In this case, for example, a voltage having a waveform such that the voltage falls steeply and rises gently can be used as the transfer voltage VA, et cetera.

Alternatively, the present invention can be preferably applied to a configuration such that after an image is once formed with one of the toner T1 having the positive charging characteristic and the toner T2 having the negative charging characteristic, further, the image is formed again using the other one (cf., Japanese Patent Provisional Publication No. HEI05-19616). In this case, after the image formation is performed with one of them, the waveform of the transfer voltage is switched and the image formation with the other one is performed.

(7) In addition to the above described embodiments of the present invention and their modifications, various embodiments and their modifications are possible within the scope which does not deviate from the gist of the present invention.

5. Summary

Finally, the embodiments of the present invention explained above are summarized in concise expressions.

According to the embodiment of the present invention, an image forming device is provided which includes a developer carrying body and a developer supply device. The developer carrying body has a developer supporting surface. The developer supporting surface is a surface parallel to a main scanning direction, and the surface on which a developer including a plurality of fine particles is supported.

As the developer carrying body, for example, an electrostatic latent image carrying body, which is configured such that on which an electrostatic latent image can be formed with an electric potential distribution, can be used. Alternatively, as the developer carrying body, for example, a recording medium (a sheet of paper), which is transferred along a sub-scanning direction perpendicular to the main scanning direction, can be used. Alternatively, as the developer carrying body, for example, an intermediary transfer body shaped like a drum or a belt, which is configured and arranged to be able to transfer the developer onto the recording medium by facing to the recording medium, can be used. In these cases, the developer supporting surface moves along the sub-scanning direction perpendicular to the main scanning direction.

The developer supply device according to the embodiment of the present invention is configured to supply the developer including a fine particle charged in a predetermined polarity and a fine particle charged in an opposite polarity which is opposite to the predetermined polarity to the developer carrying body, while transferring the developer along a developer transfer path. Here, the fine particle of the predetermined polarity, or, the fine particle of the predetermined polarity and the fine particle of the opposite polarity are used as constituents of an image part in an image to be formed.

In addition, the developer can include a fine particle having a positive charging characteristic and a fine particle having a negative charging characteristic. The fine particle having the positive charging characteristic has a tendency to be charged in a positive polarity through friction with the fine particle having the negative charging characteristic. Further, the fine particle having the negative charging characteristic has a tendency to be charged in a negative polarity through friction with the fine particle having the positive charging characteristic.

The developer supply device according to the embodiment of the present invention includes a transfer voltage applying unit and a plurality of transfer electrodes. The plurality of transfer electrodes are arranged along a developer transfer surface facing to the developer transfer path. The transfer voltage applying unit is electrically connected to the plurality of transfer electrodes so as to be able to apply traveling wave shaped transfer voltages to the plurality of electrodes.

One of the features of the embodiment of the present invention is that the transfer voltage applying unit is configured to apply the transfer voltages having waveforms, the waveforms making a fly height of the fine particle of the predetermined polarity higher than a fly height of the fine particle charged in the opposite polarity, to the transfer electrodes.

For example, when the predetermined polarity is the positive polarity, the transfer voltage applying unit can be configured to supply the transfer voltages having the waveforms, the waveforms being respectively shaped such that a rising edge is steeper than a falling edge, when an electric potential distribution is formed at the plurality of transfer electrodes toward a downstream side in a toner transfer direction.

Specifically, the transfer voltage applying unit can be configured to supply the transfer voltages such that the voltages vary in an elapsed time order of, a first high voltage, a reference voltage, a second high voltage, and the first high voltage, in one cycle, respectively, where the first high voltage is a voltage which has a first voltage difference to the reference voltage and which is higher than the reference voltage, and where the second high voltage is a voltage which has a second voltage difference, which is greater than the first voltage difference, to the first high voltage and which is higher than the first high voltage.

The image forming device and the developer supply device according to the embodiment of the present invention having such configuration operate as follows.

The traveling wave shaped voltages are applied to the plurality of transfer electrode provided along the developer transfer surface. With this, the charged developer is transferred in the developer transfer direction on the developer transfer surface. Then, an image is formed with the fine particle having the predetermined polarity transferred on the developer carrying body, and supported on the developer supporting surface, in a neighborhood of a position where a distance between the developer supporting surface and the developer transfer surface becomes the shortest.

Here, as described above, the developer including the fine particle of the predetermined polarity and the fine particle charged in the opposite polarity to the predetermined polarity is transferred in such configuration. In addition, the transfer voltage applying unit applies the transfer voltages having waveforms, the waveforms making a fly height of the fine particle of the predetermined polarity higher than a fly height of the fine particle charged in the opposite polarity, to the transfer electrodes. In addition, the reference voltage, the first high voltage, and the second high voltage are configured such that when a voltage of the transfer electrode placed at a most proximity position, the most proximity position being the closest position on the toner transfer surface to the developer supporting surface, rises from the reference voltage to the second high voltage, only the fine particle charged in the positive polarity placed at the most proximity position can reach to a fly height which allows the fine particle to adhere on the developer supporting surface, and no fine particle can reach to the fly height which allows the fine particle to adhere on the developer supporting surface at any other time. With this, a successful image formation operation can be performed, while the charged developer is more successfully transferred by the traveling wave electric fields.

What is claimed is:

1. An image forming device comprising:

a developer carrying body having a developer supporting surface configured to support developer including a plurality of fine particles; and a developer supply device configured to supply the developer to the developer carrying body, while transferring the developer along a developer transfer path, wherein the developer supply device comprises:

a plurality of transfer electrodes arranged along a developer transfer surface facing the developer transfer path, in a developer transfer direction; and a transfer voltage applying unit which is electrically connected to the plurality of transfer electrodes and is configured to apply traveling-wave shaped transfer voltages to the plurality of transfer electrodes, wherein the developer comprises a fine particle charged in a positive polarity and a fine particle charged in an negative polarity, and wherein the transfer voltage applying unit is configured to apply the traveling-wave shaped transfer voltages having waveforms, the waveforms making a fly height of the fine particle charged in the positive polarity higher than a fly height of the fine particle charged in the negative polarity, to the plurality of transfer electrodes, and the waveforms being respectively shaped such that a rising edge is steeper than a falling edge, to the plurality of transfer electrodes.

2. A developer supply device configured to supply developer to a developer carrying body having a developer supporting surface configured to support the developer, while transferring the developer along a developer transfer path, the developer supply device comprising:

a plurality of transfer electrodes arranged along a developer transfer surface facing the developer transfer path, in a developer transfer direction; and a transfer voltage applying unit which is electrically connected to the plurality of transfer electrodes and is configured to apply traveling-wave shaped transfer voltages to the plurality of transfer electrodes, wherein the developer comprises a fine particle charged in a positive polarity and a fine particle charged in opposite negative polarity, wherein the transfer voltage applying unit is configured to apply the traveling-wave shaped transfer voltages having waveforms, the waveforms making a fly height of the fine particle charged in the positive polarity higher than a fly height of the fine particle charged in the negative polarity, to the transfer electrodes, wherein the waveforms being respectively shaped such that a rising edge is steeper than a falling edge, to the plurality of electrodes.

3. The developer supply device according to claim 2, wherein the traveling-wave shaped transfer voltages vary in an order of: a first high voltage, a reference voltage, a second high voltage, and the first high voltage, in one cycle, respectively, and wherein the first high voltage is higher than the reference voltage, and the second high voltage is higher than the first high voltage, and wherein a second voltage difference between the second high voltage and the first high voltage is greater than a first voltage difference between the first high voltage and the reference voltage.

4. The developer supply device according to claim 3, wherein the reference voltage, the first high voltage, and the second high voltage are configured such that when a voltage of the transfer electrode placed at a position on the developer transfer surface closest to the developer supporting surface, rises from the reference voltage to the second high voltage, only the fine particle charged in the positive polarity placed at the position can reach to a fly height which allows the fine particle to adhere on the developer supporting surface, and no fine particle can reach to the fly height which allows the fine particle to adhere on the developer supporting surface at any other time.

5. The developer supply device according to claim 2, wherein the developer comprises a fine particle having a positive charging characteristic and a fine particle having a negative charging characteristic, wherein the fine particle having the positive charging characteristic has a tendency to be charged in the positive polarity through friction with the fine particle having the negative charging characteristic, and wherein the fine particle having the negative charging characteristic has a tendency to be charged in the negative polarity through friction with the fine particle having the positive charging characteristic.

* * * * *

UNITED STATES PATENT AND TRADEMARK OFFICE

CERTIFICATE OF CORRECTION

PATENT NO. : 8,526,865 B2
APPLICATION NO. : 12/884992
DATED : September 3, 2013
INVENTOR(S) : Kenjiro Nishiwaki It is certified that error appears in the above-identified patent and that said Letters Patent is hereby corrected as shown below:

On Title Page 2, under References Cited, Other Publications:
Please delete "JP Office Action dtd Nov. 11, 2009 JP Appln. 2008-028367."
and insert -- JP Office Action dtd Nov. 24, 2009 JP Appln. 2008-028367. --

Signed and Sealed this
Twenty-second Day of April, 2014

Michelle K. Lee

Michelle K. Lee
*Deputy Director of the United States Patent and Trademark Office*